United States Patent [19]

Ishino et al.

[11] Patent Number: 4,691,844

[45] Date of Patent: Sep. 8, 1987

[54] IMMERSION NOZZLE FOR CONTINUOUS CASTING

[75] Inventors: Yoshihiro Ishino; Sadanobu Sugiura; Kunishige Tokunaga, all of Kariya, Japan

[73] Assignee: Toshiba Ceramics Co., Ltd., Japan

[21] Appl. No.: 22,058

[22] Filed: Mar. 5, 1987

[30] Foreign Application Priority Data

Aug. 8, 1986 [JP] Japan ..... 61-186522

[51] Int. Cl.[4] ..... B22D 11/10

[52] U.S. Cl. ..... 222/591; 164/437

[58] Field of Search ..... 164/437; 222/591, 603

[56] References Cited

U.S. PATENT DOCUMENTS 4,568,007 2/1986 Fishler ..... 164/437 X

FOREIGN PATENT DOCUMENTS 50-23333 3/1975 Japan ..... 164/437
50-66432 6/1975 Japan ..... 164/437
55-158858 12/1980 Japan ..... 164/437
56-33155 4/1981 Japan ..... 164/437
57-34075 2/1982 Japan ..... 222/591
57-51172 3/1982 Japan ..... 222/591

*Primary Examiner*—Nicholas P. Godici
*Assistant Examiner*—J. Reed Batten, Jr.
*Attorney, Agent, or Firm*—Pahl, Lorusso & Loud

[57] ABSTRACT

An immersion nozzle for continuous casting includes a nozzle body and a conduit extending longitudinally through the nozzle body. At least a portion of the interior surface of the nozzle which surrounds the conduit is made of a refractory material including 40–92 wt. % $ZrO_2$, 5–40 wt. % C and 3–20 wt. % of an oxide admixture of (1) RO and $RO_2$, wherein RO is at least one member selected from the group consisting of CaO, MgO and MnO; and $RO_2$ is at least one member selected from the group consisting of $SiO_2$ and $TiO_2$; or (2) RO, $RO_2$ and $R_2O_3$ wherein RO and $RO_2$ are as defined above and $R_2O_3$ is at least one member selected from the group consisting of $Al_2O_3$ and $Cr_2O_3$.

10 Claims, 1 Drawing Figure

IMMERSION NOZZLE FOR CONTINUOUS CASTING

BACKGROUND OF THE INVENTION

This invention relates to an improved immersion or submerged nozzle for continuous casting.

Conventional immersion nozzles, sometimes referred to as "subentry nozzles", for continuous casting are made of alumina-graphite or zirconia-graphite refractories having good corrosion resistance. However, in the conventional immersion nozzle, some molten metal is apt to deposit on the inner surface of the conduit extending therethrough. In case of aluminum killed steel or the like, deposition of aluminum oxide sometimes blocks the conduit in the nozzle to such a degree that casting stops.

Blockage problems due to metal deposition can be avoided with adequate preheating and/or thermal insulation. On the other hand, in order to solve blockage problems due to aluminum oxide deposition, a porous refractory is used on the inner surface of a conduit extending through a slit type immersion nozzle to allow for introduction of an inert gas into the nozzle. However, the slits cannot be positioned near the molten metal exit of the nozzle. Thus, the blockage problems are apt to occur near the exit of the nozzle. Further, as casting is continued over a prolonged period, carbon in the porous refractory is consumed by oxidation while $SiO_2$ reacts in a C-CO reducing atmosphere to form SiO which diffuses so that permeability increases. As a result, it is difficult to control the volumetric flow rate of inert gas. Eventually, the inert gas flow rate will increase to where pinholes are formed in the steel product.

SUMMARY OF THE INVENTION

The object of the present invention is to provide an immersion nozzle for continuous casting wherein the conduit through the nozzle will not be blocked by deposits even if no inert gas is passed through the nozzle.

According to this invention, there is provided an immersion nozzle for continuous casting comprising a nozzle body and conduit formed longitudinally through the nozzle body, the nozzle body having an inner surface portion made of a refractory material including 40–92 wt.% $ZrO_2$, 5–40 wt.% C and 3–20 wt.% of an oxide material. The oxide material may be (1) an admixture of RO and $RO_2$ wherein RO is at least one member selected from the group consisting of CaO, MgO and MnO; and $RO_2$ is at least one member selected from the group consisting of $SiO_2$ and $TiO_2$; or (2) an admixture of RO, $RO_2$ and $R_2O_3$ wherein RO is at least one member selected from the group consisting of CaO, MgO and MnO; $RO_2$ is at least one member selected from the group consisting of $SiO_2$ and $TiO_2$; and $R_2O_3$ is at least one member selected from the group consisting of $Al_2O_3$ and $Cr_2O_3$. It is preferable that the whole of the nozzle body be made of the same material as that of the aforementioned inner surface portion, although this invention is not limited to such an embodiment.

As at least a portion of the inner surface of the immersion nozzle is made of a refractory material including $ZrO_2$ as its major component, it is not easily wetted with molten metal and deposition of any oxide material is avoided. Further, because C and an oxide material are included in the aforementioned inner surface portion, a glass layer is formed thereon to deter deposition of any oxide material and any aluminum component in the molten metal whereby the conduit through the nozzle will remain free of any blockage.

The formation and effect of the protective glass layer will now be explained.

When casting starts, a $RO_2$ component such as $SiO_2$ reacts with carbon in the reducing atmosphere according to the formula:

$$SiO_2 + C \rightarrow SiO\uparrow + CO\uparrow$$

Thus, a gas phase SiO is produced. When the $RO_2$ component is $TiO_2$, a similar reaction occurs.

The gas phase SiO will react with a solid phase RO component such as CaO and/or a CaO precursor. As a result of RO-$RO_2$ glass layer such as CaO-$SiO_2$ is formed on the inner surface of the conduit extending through the immersion nozzle. If a $R_2O_3$component such as $Al_2O_3$ is also present in the nozzle, a solid solution in the form of a RO-$R_2O_3$-$RO_2$ glass layer such as a CaO-$Al_2O_3$-$SiO_2$ glass layer is produced.

Because the glass layer has a high viscosity in its molten state, the inner surface of the conduit through the nozzle softens during the casting so that it can remain smooth. Therefore, oxide deposition and blockage can be avoided.

The weight ratios of the various components used for the nozzle or nozzle liner in accordance with the present invention are important for the following reasons. If $ZrO_2$ is less than 40 wt.%, if C is more 40 wt.%, or if the "oxide material" is more than 20 wt.%, then the immersion nozzle will be wetted with molten steel and deposition of some oxides cannot be properly avoided. Also, the strength of the nozzle is apt to be reduced. If $ZrO_2$ is more than 92 wt.%, if C is less than 5 wt.%, or if the "oxide material" is less than 3 wt.% then the above-described glass layer is not readily formed on the inner surface of the conduit through the nozzle so that deposition of the oxides cannot be properly avoided.

In order to obtain the best results, the amount of the "oxide material" is chosen so that the composition of the glass layer becomes 10–60 wt.% RO, 0–50 wt.% $R_2O_3$ and 30–80 wt.% $RO_2$. Such a glass layer has a high viscosity at a temperature of about 1350°–1550° C. because it is molten within that temperature range.

The foregoing components are admixed, cast and fired in accordance with conventional ceramic practice to produce the nozzles of the present invention.

Accordingly, the present invention provides an immersion nozzle for continuous casting which is excellent in avoiding deposition of oxides or the like on the inner surface of its conduit during continuous casting even where no inert gas is used.

DETAILED DESCRIPTION OF PREFERRED EMBODIMENTS

Figure 1:
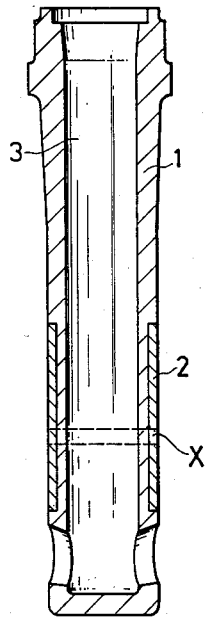
FIG. 1 is a schematic sectional view showing an immersion nozzle for continuous casting according to this invention.

Referring to FIG. 1, an immersion nozzle for continuous casting has a nozzle body 1, a slag line portion 2 (protection sheath) located around its outer surface and a conduit 3 formed through the nozzle body 1. The conduit 3 is substantially defined by the inner surface of the nozzle body 1. The nozzle body 1 is integral with the slag line sheath 2. Such an integral structure can be formed by a conventional method as disclosed in Japanese Patent Publication No. 54-40447, for example.

Eight samples of the nozzle body 1 were made of eight refractory materials as shown in Table 1 and Table 2. Such refractory materials can be obtained, for example, by admixing starting materials as shown in Table 3. Sample Nos. 1 to 4, 7 and 8 represent embodiments of this invention while Sample Nos. 5 and 6 are comparative samples outside of the scope of this invention. In all samples, the slag line portion 2 is made of a refractory material including 77 wt.% $ZrO_2$ and 15 wt.% C.

The samples were attached to a tundish for continuous casting. In each test, aluminum killed steel was continuously cast ten times. After that, a piece was cut from a portion X shown in FIG. 1 in order to test for deposits formed on the inner surface of the conduit in the nozzle body 1. The deposition rate of the deposits is expressed by the formula:

$$\text{Deposition Rate (\%)} = (\text{Cross-Sectional Area of Deposits})/(\text{Cross-Sectional Area of Conduit Before Use}) \times 100$$

As can be seen in Table 1, in the comparative sample No. 5, the deposition rate was very high. In the comparative sample No. 6, the deposition rate was also very high, and the strength of the nozzle declined. In contrast, with samples Nos. 1 to 4, 7 and 8 according to this invention, the strength of the nozzles remained high, and the deposition rate was very low, almost 1/6 to $\frac{1}{8}$ that of the comparative sample No. 5. Accordingly, the samples Nos. 1 to 4, 7 and 8 showed excellent resistance to deposition of any oxides on the inner surface of their conduits.

TABLE 1

| | SAMPLE | | | | | |
|---|---|---|---|---|---|---|
| | 5 | 1 | 2 | 3 | 4 | 6 |
| Deposition (wt %) | | | | | | |
| $ZrO_2$ | — | 68.2 | 77.6 | 82.4 | 51.2 | 41.6 |
| C | 31.4 | 26.4 | 15.6 | 10.1 | 26.6 | 27.5 |
| $Al_2O_3$ | 51.8 | 0.7 | 1.6 | 0.5 | 5.0 | 19.1 |
| $SiO_2$ | 16.8 | 1.0 | 2.0 | 0.5 | 2.5 | 8.8 |
| CaO | — | 3.0 | 3.2 | 3.6 | 11.9 | 1.8 |
| Apparent % Porosity | 17.5 | 17.3 | 16.4 | 16.0 | 17.4 | 17.9 |
| Bulk Density | 2.31 | 3.18 | 3.69 | 3.98 | 2.94 | 2.69 |
| Compression Strength Kg/cm$^2$ | 230 | 249 | 289 | 315 | 283 | 185 |
| Deposition Rate % | 47.4 | 5.9 | 6.3 | 6.5 | 8.0 | 27.1 |

TABLE 2

| | | | SAMPLE No. | |
|---|---|---|---|---|
| | | | 7 | 8 |
| Deposition (wt %) | $ZrO_2$ | | 61.5 | 63.0 |
| | C | | 24.0 | 24.5 |
| | RO | CaO MgO MnO | 2.5 | 2.0 |
| | $RO_2$ | $SiO_2$ $TiO_2$ | 12.0 | 10.5 |
| Apparent (%) | | | 17.7 | 17.3 |

TABLE 2-continued

| | SAMPLE No. | |
|---|---|---|
| | 7 | 8 |
| Porosity | | |
| Bulk Density | 2.93 | 3.01 |
| Compression Strength (Kg/cm$^2$) | 248 | 261 |
| Deposition Rate (%) | 6.2 | 6.4 |

TABLE 3

| SAMPLE No. | 7 and 8 | 1, 2, 3 and 4 | |
|---|---|---|---|
| sintered alumina | — | — | 10.0 wt. % |
| stabilized zirconia | 65.0 wt. % | 75.0 wt. % | 57.5 wt. % |
| natural graphite | 24.0 wt. % | 23.5 wt. % | 27.5 wt. % |
| admixture ($SiO_2$ + $Al_2O_3$) | — | 1.5 wt. % | 2.0 wt. % |
| fused silica | 11.0 wt. % | — | 3.0 wt. % |
| binder | 20.0 wt. % | 15.0 wt. % | 18.0 wt. % |

We claim:

1. An immersion nozzle for continuous casting, comprising an elongated nozzle body and a conduit extending longitudinally through said nozzle body, said nozzle body having an interior surface defining said conduit, at least a portion of said interior surface being formed of a refractory material including 40–92 wt.% $ZrO_2$, 5–40 wt.% C, and 3–20 wt.% of an admixture of RO and $RO_2$ wherein RO is at least one member selected from the group consisting of CaO, MgO and MnO; and $RO_2$ is at least one member selected from the group consisting of $SiO_2$ and $TiO_2$.

2. An immersion nozzle as defined in claim 1, wherein the whole of said nozzle body is made of said refractory material.

3. An immersion nozzle as defined in claim 1, additionally comprising a slag line protection sheath formed around an exterior surface of the nozzle body.

4. An immersion nozzle as defined in claim 3, wherein the slag line protection sheath is made of a refractory material including 77 wt.% $ZrO_2$ and 15 wt.% C.

5. An immersion nozzle as defined in claim 3, wherein the nozzle body is integral with said line protection sheath.

6. An immersion nozzle for continuous casting comprising an elongated nozzle body and a conduit extending longitudinally through said nozzle body, said nozzle body having an interior surface defining said conduit, at least a portion of said interior surface being formed of a refractory material including 40–92 wt.% $ZrO_2$, 5–40 wt.% C, and 3–20 wt.% of an admixture of RO, $RO_2$ and $R_2O_3$ wherein RO is at least one member selected from the group consisting of CaO, MgO and NnO; and $RO_2$ is at least one member selected from the group consisting of $SiO_2$ and $TiO_2$; and $R_2O_3$ is at least one member selected from the group consisting of $Al_2O_3$ and $Cr_2O_3$.

7. An immersion nozzle as defined in claim 6, wherein the whole of the nozzle body is formed of said refractory material.

8. An immersion nozzle as defined in claim 6, additionally comprising a slag line protection sheath formed around an exterior surface of the nozzle body.

9. An immersion nozzle as defined in claim 8, wherein the slag line protection sheath is made of a refractory material including 77 wt.% $ZrO_2$ and 15 wt.% C.

10. An immersion nozzle as defined line claim 8, wherein the nozzle body is integral with said slag line protection sheath.

* * * * *